US010194751B1

(12) United States Patent
Frankel et al.

(10) Patent No.: US 10,194,751 B1
(45) Date of Patent: Feb. 5, 2019

(54) SPLIT-FOLDING FURNITURE SUPPORT DEVICE

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 15/705,417

(22) Filed: Sep. 15, 2017

(51) Int. Cl.

| | |
|---|---|
| ***A47C 9/00*** | (2006.01) |
| ***A47C 9/10*** | (2006.01) |
| ***A47C 4/28*** | (2006.01) |
| ***A47B 3/00*** | (2006.01) |
| ***A47C 3/18*** | (2006.01) |

(52) U.S. Cl.
CPC ..... *A47C 9/105* (2013.01); *A47B 3/002* (2013.01); *A47C 3/18* (2013.01); *A47C 4/286* (2013.01); *A47B 2003/006* (2013.01)

(58) Field of Classification Search
CPC ..... F16M 11/38; F16M 11/16; F16M 11/245; F16M 11/34; A47B 97/08; A47B 3/00
USPC ..... 248/163.1, 168, 434, 435, 177.1, 188.6, 248/188.7
See application file for complete search history.

(56) References Cited

U.S. PATENT DOCUMENTS

| | | | | |
|---|---|---|---|---|
| 476,805 A * | 6/1892 | Mason | A47C 9/00 | 297/461 |
| 517,929 A * | 4/1894 | March | A47C 9/00 | 297/461 |
| 1,408,581 A * | 3/1922 | Gaudreau | A47C 9/105 | 108/128 |
| 1,527,941 A * | 2/1925 | Weidner | A47C 9/105 | 248/170 |
| 6,575,422 B1 * | 6/2003 | Zheng | A47B 3/04 | 108/118 |

* cited by examiner

*Primary Examiner* — Steven M Marsh
(74) *Attorney, Agent, or Firm* — Merek, Blackmon & Voorhees, LLC

(57) ABSTRACT

A split folding furniture support device having an upper support portion and a lower support portion. The upper support section is connected and secured to the lower support section as the shaft inserts into the guide tube. The lower end of the upper main plate touches the upper end of lower main plate forming a load-bearing support. The device can be used to make folding tables, thin waist stool and rotary backrest chair with split, fold and rotation functions.

11 Claims, 7 Drawing Sheets

SPLIT-FOLDING FURNITURE SUPPORT DEVICE

BACKGROUND OF THE INVENTION

Field of the Invention

The present invention relates to the field of folding furniture, and more particularly to a split-type, folding-furniture, support device, in particular, to achieve up-and-down split folding, as well as up-and-down relative rotation.

Technical Background

China Patent Application No. 99248377.8 discloses a rotary apparatus for a folding type of furniture comprising a rotatable assembly installed between two disc-shaped pieces. The rotatable assembly is placed in a space in the depressions of the two discs so that the two discs are free to rotate. The rotary assembly consists of two ring-shaped pads with a rotating element, which forms the end bearing. Although the structure can support the rotation function, the two discs cannot be released, and as the upper and lower support part fold, the height increases and cause inconvenience for storage.

China Patent Application No. 201310172771.4 shows an outdoor chair comprising a loading part and a support arranged vertically and connected by a cushion, a backrest supporting tube and a seat tube supporting the cushion; the connecting part is installed with multiple plugs that are respectively connected to the back-support tube and seat tube in a detachable fashion. Bearings are installed at the connecting part between the loading part and the support, to fulfill rotation functions. However, the loading part and the tubes on the support all use plugs to form a removable connection. As a result, the upper and lower parts have at least eight tubes, making assembly and disassembly troublesome, time-consuming, and difficult to ensure the strength of the joint.

This design provides bearings between the upper and lower portions to fulfil rotation functionality, and allocates three to four single tube fittings to jointly support the cushion portion. If the user sits on the middle of the seat, the weight can also be evenly distributed to the four-support pipe, but the actual process of siting and standing up often involves deviation of body weight from the center, with the center of weight moving forward or side to one individual support pipe which leads to a bending or breaking hazard and renders the design impractical.

How to overcome the shortcomings of the existing technology and provide a split which can be folded in to a compact, storage-friendly size is an objective of the current invention.

SUMMARY OF THE INVENTION

An objective of present invention is to provide a split-type, folding furniture support device in which a split upper support portion and a lower support portion are connected by a shaft which is inserted into a guide tube to form a flexible joint connecting two parts that can rotate relative to each other.

The technical proposal of the invention can be achieved in the following way:

A split-folding furniture support device comprising: an upper support portion and a lower support portion; with one or more of the following features:

The upper support portion includes an upper main plate, upper auxiliary plate, upper support rod, upper link and shaft.

The upper ends of multiple support rods are hinged at one end to the upper main plate and the other ends are used to support the furniture fabric.

A corresponding number of upper ends of the connecting rod are hinged on the upper support rod and the other end is hinged on the upper auxiliary plate.

The shaft is locked on the upper auxiliary plate, going through a prefabricated hole on the upper main plate.

As the upper support rod being opened in place, the shaft extends downward through the main plate.

The lower support section includes a lower main plate, a lower auxiliary plate, a lower support rod, a lower link and a guide tube.

The lower ends of multiple support rods are hinged at one end to the upper main plate, a corresponding number of lower ends of the connecting rod are hinged on the lower support rod and the other ends are hinged on the lower auxiliary plate.

The guide tube is locked on the lower main plate, going through a prefabricated hole on the upper auxiliary plate.

As the lower support rod being opened in place, the guide tube extends downward through the lower auxiliary plate.

The upper support section is connected and secured to the lower support section as the shaft inserts into the guide tube. The lower end of the upper main plate touches the upper end of lower main plate, forming a load-bearing support.

The three to six lower support rods are radially distributed on the lower main plate, and three to six upper supporting rods are distributed radially on the upper main plate, and the furniture fabric unfolds in a flat shape by the upper supporting rod.

The three to six lower support rods are radially distributed on the lower main plate, four support rods are divided into a pair of cushion rods and a pair of backrest rods and respectively hinged on the main plate. When opening, two cushion rods stretch forward and two backrest rods tilt up.

The cushion rods and the upper connecting rod are hinged at a straight section, forming an angle of 20 to 35 degrees with the horizontal plane. The backrest rods and the upper connecting rod are hinged at a straight section, forming an angle of 55 to 65 degrees with the horizontal plane.

The cushion rods have a bending section on the far end from the upper main plate, as the bending sections of the two cushion rods bends inside towards each other; the backrest rods a double bending section on the far end from the upper main plate, and the double bending sections of the two backrest rods bends inside towards each other as well as tilt upward.

The upper auxiliary plate which matches the upper main plate is lower at front and higher at back, with upper and lower hinge slots. The two upper links hinged to the cushion rods are hinged at one end to the lower hinge slots, and the two upper links hinged to the backrest rods are hinged to the upper hinge slots.

The guide tube has a ribbed keyway on which a screw or slider is locked, and the screw or slider works with the rib keyway to restrain the range of rotation of the upper support section.

A support ring with a through hole at its center is provided on the upper face of the lower main plate, and the support ring is in contact with the lower face of the upper main plate.

The upper and lower support sections of the present invention are provided with a shaft and a matching guide pipe so as to not only connect and lock the upper and lower sections in place, but to also serve as the center of the rotation shaft for the rotation of the upper support portion. It is easy to disassemble and assemble as the shaft retract and fold with the upper section without taking extra space. The upper and lower support sections can be split folded and stored side by side, greatly reducing the height and size after folding. It can be used to make folding tables, thin waist stool and rotary backrest chair with split, fold and rotation functions.

BRIEF DESCRIPTION OF THE DRAWINGS

Similar reference characters denote corresponding features consistently throughout the attached drawings. Namely, in the drawings the following reference numbers refer to the following part.

1—furniture fabric
11—triangle stool face
12—quadrilateral table face
13—cushion
14—backrest
15—armrest
2—upper support section
21—upper main plate
22—upper auxiliary plate
221—lower hinge slot
222—upper hinge slot
23—upper support rod
231—cushion rod
2311—bending section
232—backrest rod
2321—double-bending rod
24—upper link
25—shaft
251—slider
3—lower support section
31—lower main plate
311—through hole
312—support ring
32—lower auxiliary plate
33—lower support rod
34—lower link
35—guide tube
351—ribbed keyway
A—the angle between the cushion rod and the horizontal plane
B—the angle between the backrest rod and the horizontal plane

DETAILED DESCRIPTION OF THE PREFERRED EMBODIMENT(S)

Example/Embodiment 1

Figure 1:
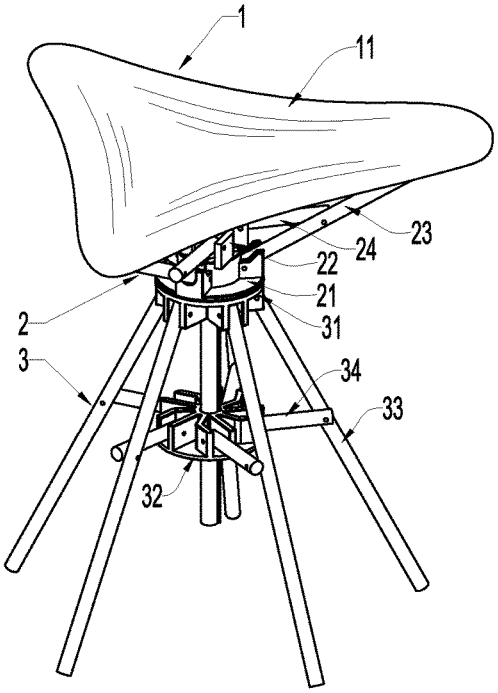
FIG. 1 shows a triangular stool stereogram.
Figure 2:
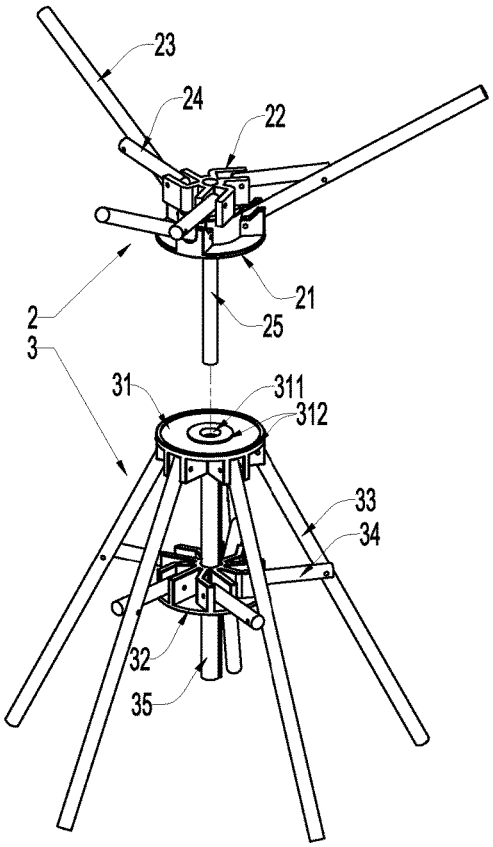
FIG. 2 shows a sectional view of the support device of a triangular stool.
Figure 3:
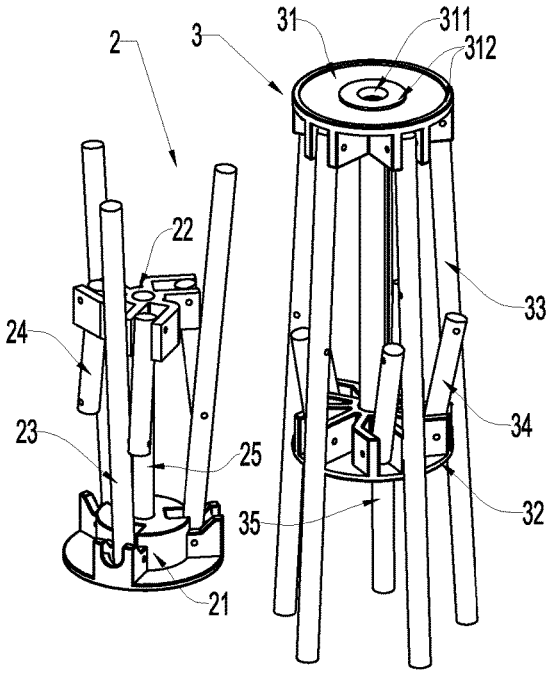
FIG. 3 shows a split fold view of the support device of a triangular stool.

With reference to FIGS. 1, 2 and 3, the present invention is to a split folding triangular stool, where the furniture fabric 1 is cut into a triangular stool surface 11, and is supported by a support device having a split folding function, comprising an upper support section 2 and the lower support section 3.

The upper support section 2 includes an upper main plate 21, an upper auxiliary plate 22, an upper support rod 23, an upper link 24 and a shaft 25. The triangular stool surface 11 is supported by the ends of the three upper support rods 23. The other end is hinged to the upper main plate 21, and the corresponding number of upper links 24 are hinged on the upper support rod 23 with the other end hinged to the upper auxiliary plate 22. The shaft 25 is locked on the upper auxiliary plate 22 and goes through the hole on upper main plate 21. One adjusts the space between the upper main plate and upper auxiliary plate to open or fold the multiple upper support rods 23 as shown in FIG. 2 as the upper support rod 23 is opened to position, and the shaft 25 extends downwardly out of the main plate 21.

The lower support section 3 includes a lower main plate 31, a lower auxiliary plate 32, a lower support rod 33, a lower link 34 and a guide pipe 35, and multiple lower base support rods 33 hinged to the lower main plate 31. The corresponding number of lower link 34 is hinged on one end to the lower support rod 33 and hinged on the other end to the lower auxiliary plate 32. Three to six lower support rods 33, five in this figure, are evenly distributed on the lower main plate 31. The lower end of the lower support rod 33 is grounded, forming a stable support. The guide tube 35 is locked in the through hole 311 of the lower main plate 31 and goes through the hole on the lower auxiliary plate 32. The lower support rod 33 opens to position and the guide tube 35 extends downwardly below the lower auxiliary plate 32. For this purpose, the length of the tube 35 can be designed so that when the lower support rod 33 is in place, it is in contact with the ground, forming a central support.

In FIG. 2, the upper support section 2 is inserted into the guide tube 35 by means of the shaft 25 so as to connect and align with the lower support section 3. The lower end face of the upper main plate 21 is in contact with the upper end face of the lower main plate 31 to form load bearing. For this reason, the upper end surface of the lower main plate 31 is provided with a support ring 312 having a through hole 311 at center, and the support ring 312 is in contact with the lower end surface of the upper main plate 21 to reduce the frictional force so that the upper support section 2 can rotate freely.

FIG. 3, the split and fold view of the support device of a triangular stool, shows that the upper and lower support section 2, 3 can be stored side by side, reducing the overall height and size, making easier both carry and storage.

In addition to the triangular stool, a symmetrical structure such as a square stool or a hexagonal stool can be designed in which three to six lower support rods 33 are distributed radially on the lower main plate 31 and three to six upper support rods 23 are distributed radially on the upper main plate 21. The furniture fabric unfolds in a flat shape by the upper supporting rod. The length of the upper support rod 23 and the lower support rod 33 and the opening angle can be designed to form an upper and lower symmetrical shape.

Example/Embodiment 2

Figure 4:
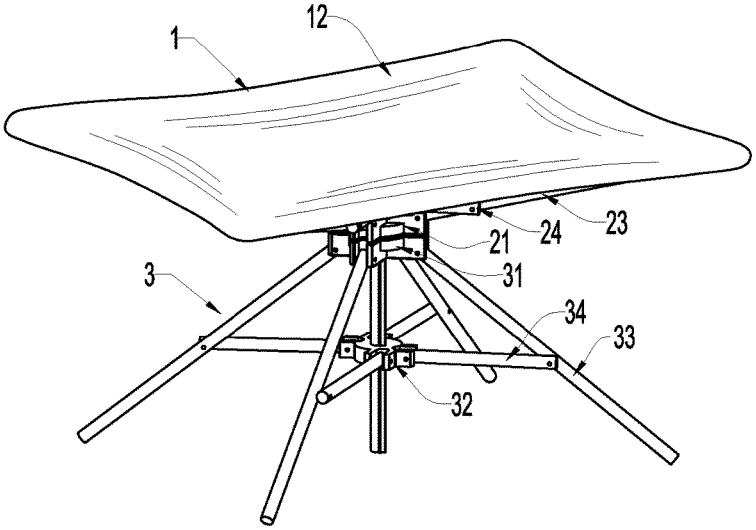
FIG. 4 shows a quadrilateral table stereogram.
Figure 5:
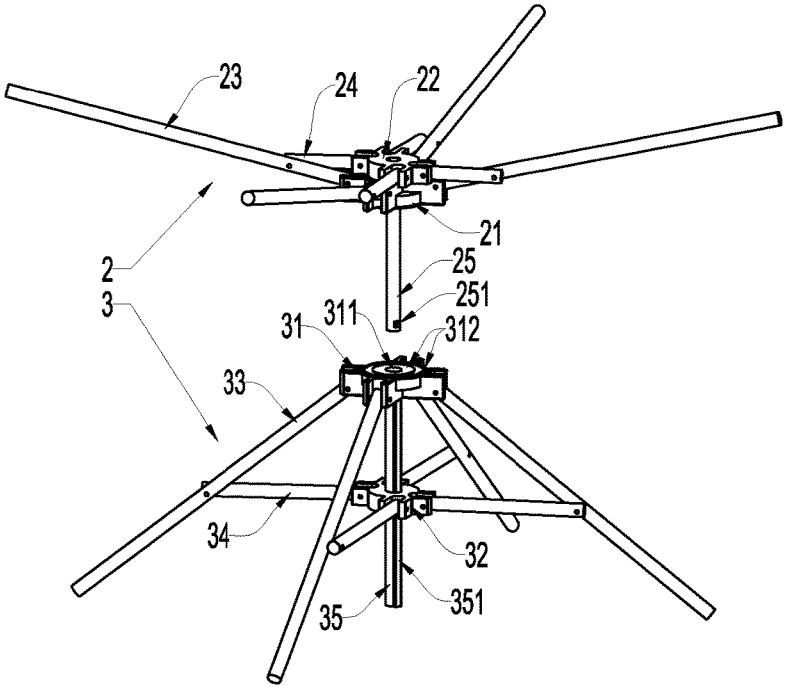
FIG. 5 shows a sectional view of the support device of a quadrilateral table.
Figure 6:
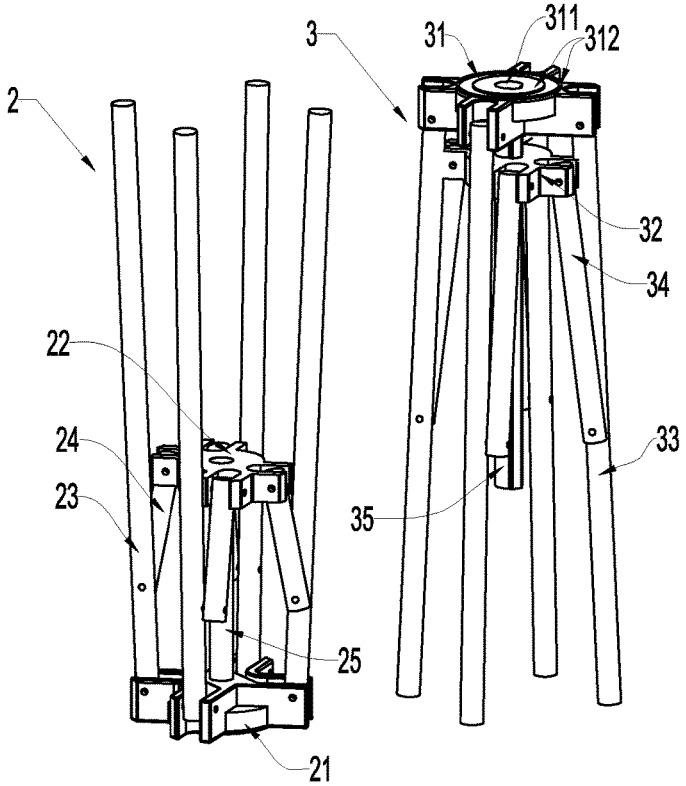
FIG. 6 shows a split-fold view of the support device of a quadrilateral table.

In FIGS. 4, 5 and 6, the embodiment is to a split folding square table, where the furniture fabric 1 is cut into a square table surface 12, which is supported by a support device which has a split folding function, comprising an upper support section 2 and the lower support section 3.

In the present example, four upper support rods 23 are provided in the upper support section 2, and four lower support rods 33 are provided in the lower support section 3. If the four side tables 12 are square, the upper support rods 23 are evenly distributed on the upper main plate 21, and the lower support bars 33 are evenly distributed on the lower main plate 31. One skilled in the art however would appreciate that would also be applicable to pentagonal and hexagonal tables.

In the present example of rectangular table 12 in which the upper and lower support rods are symmetrical in both ends, to avoid the rotation of the four-sided table top 12, an anti-rotation structure can be provided in the shaft 25 and the guide pipe 35, as shown in FIG. 5. The guide tube 35 has a rib keyway 351 which is locked with a screw or slider 251 which works with the rib keyway 351 to restrain the upper support section 2 from rotating to prevent the table top 12 from rotating and the center of gravity moving outwards and causing instability. In square desktop, this limitation is not needed as a rotating desktop can have its own use and convenience.

Example/Embodiment 3

In FIGS. 7 to 13, the example shown is to a split folding backrest chair, where the furniture fabric 1 is cut into a cushion section 13 having a split body structure, a backrest 14, and an armrest 15 supported by a support device having a split folding function, comprising: an upper support section 2 and the lower support section 3.

The lower support section 3 has three to six lower support bars 33 evenly distributed on the lower main plate 21 to form an all-round support, however it is preferable to provide five support bars 33 to prevent the single lower support bar 33 from being loaded.

Figure 12:
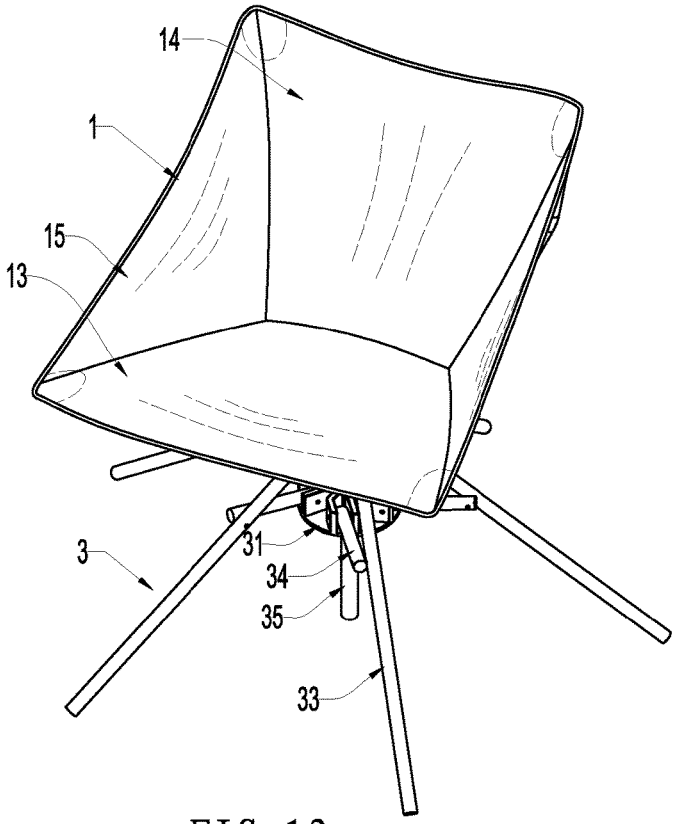
FIG. 12 shows a backrest chair stereogram.

The four upper support rods 23 are divided into a pair of seat rods 231 and a pair of backrest rods 232 which are respectively hinged to the upper main plate 21. In the open position, the two cushion rods 231 extend forward to the cushion 13, the two backrest rods 232 tilt upward to open the backrest 14, and the armrest is naturally opened by the end of the cushion rods 231 and backrest rods 232, forming a flexible fabric chair with an armrest portion 15, as shown in FIG. 12.

Figure 10:
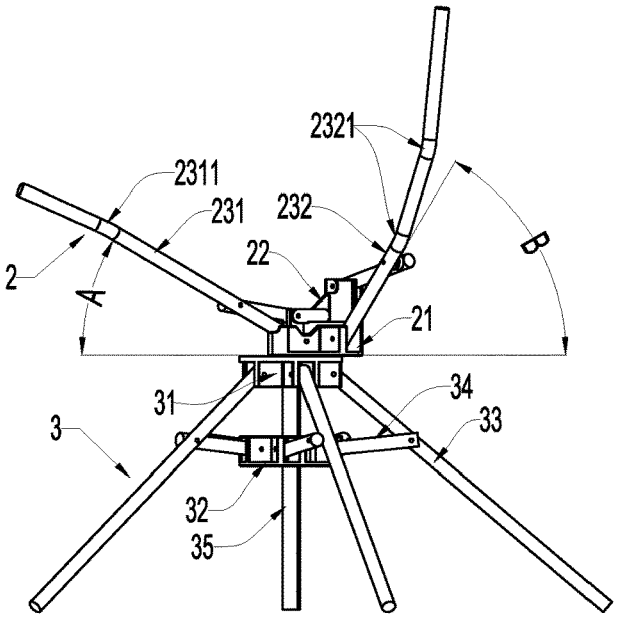
FIG. 10 shows a side view of the support device of a backrest chair.
Figure 11:
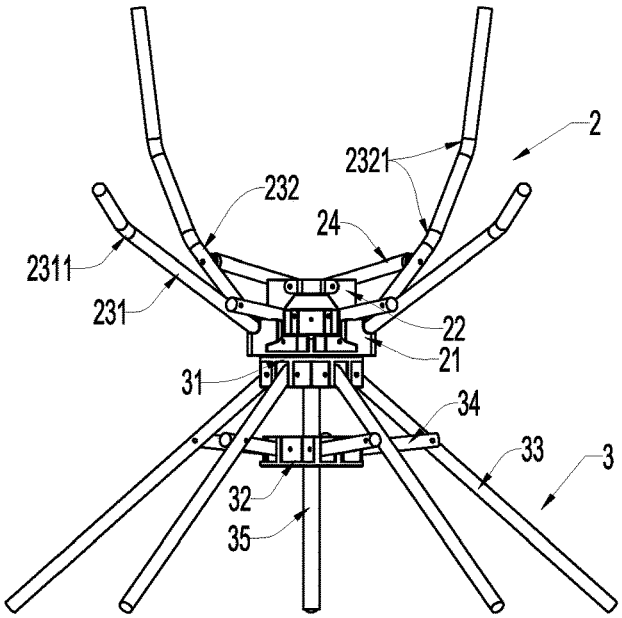
FIG. 11 shows a frontal view of the support device of a backrest chair.

In FIGS. 10 and 11, the hinge section of the cushion rod 231 and the upper link 24 is shown as a straight section having an angle A between 20 and 35 degrees from the horizontal plane. The backrest rods 232 and the upper link 24 are hinged at a straight section having an angle B between 55 and 65 degrees from the horizontal plane. Further, at the far end of cushion rod 231 from the upper main plate 21 is a bending portion 2311, and the bending portion 2311 of the two cushion rods tilt inward towards each other. At the far end of backrest rod 231 from the upper main plate 21 is a bending portion 2321, and the bending portion 2321 of the two cushion rods tilt inward as well as upwards. The shape of the backrest chair is molded by the seat rods 231 and the backrest rods 232, which conforms to the ergonomic design requirements.

Figure 7:
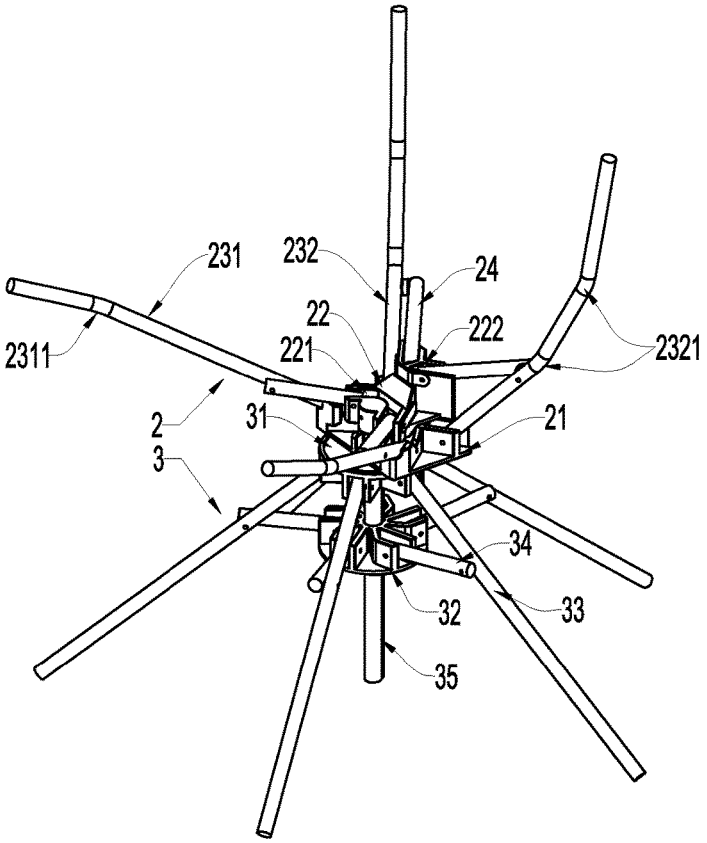
FIG. 7 shows a stereogram of the support device of a backrest chair.
Figure 8:
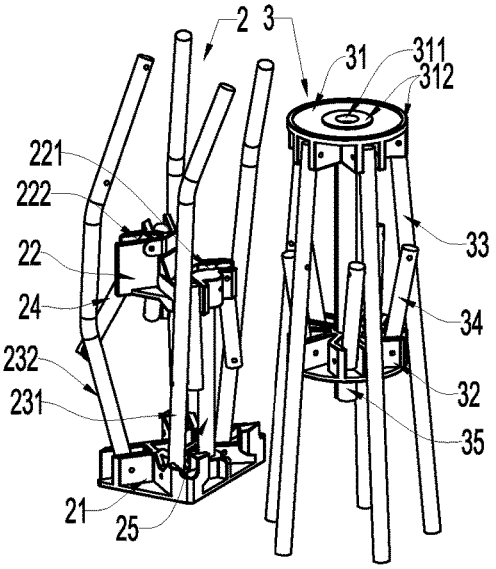
FIG. 8 shows a split fold view of the support device of a backrest chair.
Figure 9:
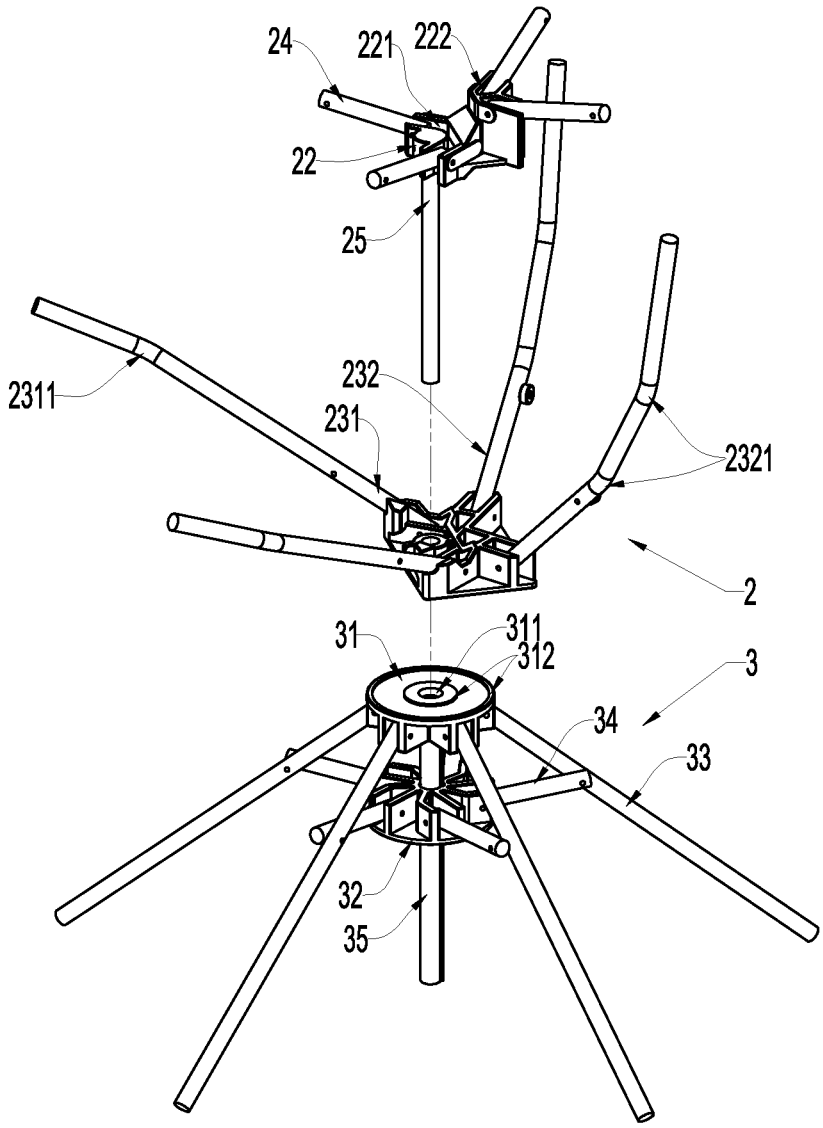
FIG. 9 shows a sectional view of the support device of a backrest chair.

In FIGS. 7, 8 and 9, the upper auxiliary plate 22 which matches the upper main plate 21, is lower at front and higher at back, with upper hinge slots 221 and lower hinge slots 222, the two upper links 24 hinged to the cushion rods 231 are hinged at one end to the lower hinge slots 221, and the two upper links 24 hinged to the backrest rods 232 are hinged to the upper hinge slots 222, so as to accommodate the upward movement of the backrest 232. The upper auxiliary plate 22 is opened in place at the upper support section 2 and the lower end face goes in contact with the upper end face of the upper main plate 21 to reduce rocking. In this design, the guide tube 35 is opened in place beneath the lower support section 3 and forms support on the ground at the center position to increase the stability and bearing capacity of the backrest chair. The vertical stability of the guide tube 35 also stabilizes the shaft 25, not only reducing swaying, but also having better rotational performance.

The upper end surface of the lower main plate 31 is provided with a support ring 312, which has a through hole 311 at its center, and the support ring 312 is in contact with the lower end surface of the upper main plate 31 to obtain a wider range of support, and reduce the friction for a more freely rotation.

Figure 13:
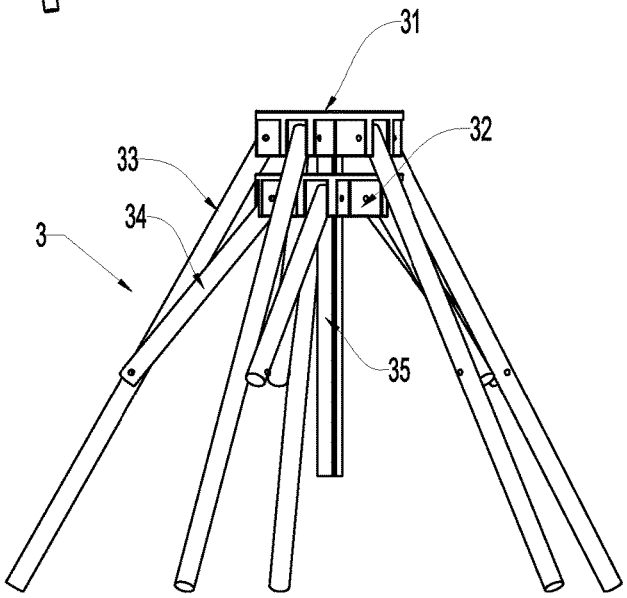
FIG. 13 shows the lower support device.

As in FIGS. 7, 8 and 13, when folding the upper main plate 21 and the upper auxiliary plate 22 in the upper support section, the lower main plate 31 and the lower auxiliary plate 32 in the lower support section 3 are both moving in opposite direction during folding and moving in the same direction during opening. The upper link 24 and lower link 34 are shorter and sufficient, but for the lower support section 3, the lower support rod 33 is hinged to the lower link 34 at a relatively high spot with a weaker correlation and the lower support rod 33 withstanding greater pressure. For this purpose, a proposal is shown in FIG. 13 in which the movement of the lower auxiliary plate 32 of the lower support section 3 is adjusted. In this way, the lower link 34 can be hinged to a lower position of the lower support bar 33, so that the lower support section 3 is more stable.

We claim:

1. A split folding furniture support device comprising:

an upper support portion, a lower support portion and a furniture fabric;

the upper support portion includes an upper main plate, an upper auxiliary plate, multiple upper support rods, multiple upper links and a shaft;

the upper support rods are hinged at a first end to the upper main plate and are connected at a second end to the furniture fabric;

a corresponding number of first ends of the multiple upper links are hinged to the upper support rod and hinged to the upper auxiliary plate;

the shaft is locked on the upper auxiliary plate and is inserted through a prefabricated hole on the upper main plate, such that when the upper support rod is opened in place, the shaft extends downwardly through the main plate;

the lower support section includes a lower main plate, a lower auxiliary plate, multiple lower support rods, multiple lower links and a guide tube;

upper ends of the multiple lower support rods are hinged to the lower main plate, lower ends of the multiple lower links are hinged at one end to the lower support rods and at a second end to the lower auxiliary plate;

the guide tube is locked on the lower main plate and is inserted through a prefabricated hole on the lower auxiliary plate, such that when the lower support rod is opened in place, the guide tube extends downwardly through the lower auxiliary plate;

the upper support section is rotatably secured to the lower support section by inserting the shaft into the guide tube;

the lower end of the upper main plate rests on the upper end of lower main plate, forming a load-bearing support when the shaft is inserted into the guide tube.

2. The split folding furniture support to claim 1, a split folding support device with the following features:

said multiple upper support rods comprises a range of three to six lower support rods;

said multiple lower support rods comprises a range of three to six lower support rods;

wherein said three to six lower support rods are radially distributed on the lower main plate, and said three to six upper supporting rods are distributed radially on the upper main plate, and the furniture fabric unfolds in a flat shape on the upper supporting rod.

3. The split folding furniture support to claim 1, further comprising two cushion rods and two backrest rods, wherein when opening, the two cushion rods stretch forward and the two backrest rods tilt up.

4. The split folding furniture support to claim 3, wherein the cushion rods and the upper connecting rod are hinged at a straight section, forming an angle of 20 to 35 degrees with a horizontal plane; and the backrest rods and the upper connecting rod are hinged at a straight section, forming an angle of 55 to 65 degrees with the horizontal plane.

5. The split folding furniture support to claim 4, wherein the cushion rods have a bending section on a far end from the upper main plate, as the bending sections of the two cushion rods bends inside towards each other; and the backrest rods includes a double bending section at a far end from the upper main plate, and the double bending sections of the two backrest rods bends inside towards each other as well as tilt upward.

6. The split folding furniture support to claim 3, wherein the cushion rods have a bending section on a far end from the upper main plate, as the bending sections of the two cushion rods bends inside towards each other; and the backrest rods a double bending section on a far end from the upper main plate, and the double bending sections of the two backrest rods bends inside towards each other as well as tilt upward.

7. The split folding furniture support to claim 3, wherein the upper auxiliary plate is lower at front and higher at back with upper and lower hinge slots;

the two upper links hinged to the cushion rods are hinged at one end to the lower hinge slots;

and the two upper links hinged to the backrest rods are hinged to the upper hinge slots.

8. The split folding furniture support to claim 1, wherein the guide tube has a ribbed keyway on which a screw or slider is locked, wherein the screw or slider works with the rib keyway to restrain a range of rotation of the upper support section.

9. The split folding furniture support to claim 1, wherein a support ring that has a through hole at its center is provided on the upper face of the lower main plate, and the support ring is in contact with a lower face of the upper main plate.

10. The split folding furniture support to claim 2, wherein a support ring that has a through hole at its center is provided on the upper face of the lower main plate, and the support ring is in contact with a lower face of the upper main plate.

11. The split folding furniture support to claim 3, wherein a support ring that has a through hole at its center is provided on the upper face of the lower main plate, and the support ring is in contact with a lower face of the upper main plate.

* * * * *